US012798820B2

(12) United States Patent
Rittri

(10) Patent No.: US 12,798,820 B2
(45) Date of Patent: Nov. 17, 2026

(54) CONTAINER WITH BOTTOM OPENING AND METHOD OF FILLING SUCH CONTAINER

(71) Applicant: Bluewater Innovations AB, Stockholm (SE)

(72) Inventor: Bengt Rittri, Stockholm (SE)

(73) Assignee: Bluewater Innovations AB, Stockholm (SE)

( * ) Notice: Subject to any disclaimer, the term of this patent is extended or adjusted under 35 U.S.C. 154(b) by 148 days.

(21) Appl. No.: 18/563,308

(22) PCT Filed: May 11, 2022

(86) PCT No.: PCT/EP2022/062835
§ 371 (c)(1),
(2) Date: Nov. 21, 2023

(87) PCT Pub. No.: WO2022/248232
PCT Pub. Date: Dec. 1, 2022

(65) Prior Publication Data

US 2024/0217692 A1 Jul. 4, 2024

(30) Foreign Application Priority Data

May 27, 2021 (SE) ..... 2150671-2

(51) Int. Cl.
*B65D 1/06* (2006.01)
*B65D 1/20* (2006.01)
(Continued)

(52) U.S. Cl.
CPC ..... *B65D 1/20* (2013.01); *B65D 47/121* (2013.01); *B65D 47/122* (2013.01); *B65D 51/18* (2013.01);
(Continued)

(58) Field of Classification Search
CPC ..... Y10S 220/916; B65D 1/06; B65D 47/121; B65D 47/122; B65D 47/126;
(Continued)

(56) References Cited

U.S. PATENT DOCUMENTS 766,604 A * 8/1904 Dilg ..... B65D 11/02 220/916
780,292 A * 1/1905 Jones ..... B65D 47/185 220/916
(Continued)

FOREIGN PATENT DOCUMENTS

CA 2695042 A1 10/2010
CA 2697470 A1 9/2011
(Continued)

OTHER PUBLICATIONS

International Search Report issued in International Application No. PCT/EP2022/062835 mailed May 11, 2022, in 11 pages.
(Continued)

*Primary Examiner* — Charles P. Cheyney
(74) *Attorney, Agent, or Firm* — Knobbe, Martens, Olson & Bear, LLP

(57) ABSTRACT

There is disclosed a container (100) configured to hold a fluid or granular substance and extending along an axis A. The container comprises a top part (110). The top part comprises a container body (120) configured to hold the fluid or granular substance, and a first opening (130) with a first area (A1). The container further comprises a bottom part (140) configured to be permanently fitted to the top part. The bottom part comprises a second resealable opening (150) with a second area (A2), the second area is larger than the first area. There is also disclosed a method for filling a container.

11 Claims, 5 Drawing Sheets

(51) Int. Cl.
*B65D 47/12* (2006.01)
*B65D 51/18* (2006.01)

(52) U.S. Cl.
CPC ..... *B65D 2251/0025* (2013.01); *B65D 2251/0081* (2013.01)

(58) Field of Classification Search
CPC ..... B65D 47/128; B65D 2251/0025; B65D 2251/0081; B65D 51/18
USPC ..... 222/562, 478; 220/916, 212; 215/370
See application file for complete search history.

(56) References Cited

U.S. PATENT DOCUMENTS 1,225,610 A 5/1917 Garner
1,432,718 A * 10/1922 Moore ..... B65D 3/06 206/520
1,751,315 A * 3/1930 Fox ..... A47J 43/27 220/916
1,776,458 A 9/1930 Tsuchiya
1,858,864 A 5/1932 Podel
1,862,835 A 6/1932 Tsuchiya
2,125,417 A * 8/1938 Baker ..... B65D 43/022 229/5.5
2,134,427 A * 10/1938 Biderman ..... B65D 3/22 229/162.5
2,207,003 A * 7/1940 Dunlap ..... B65D 3/10 229/5.5
2,695,744 A 11/1954 Gattuso
3,722,784 A 3/1973 Harper
4,261,502 A * 4/1981 Ohmori ..... B29C 66/81427 229/404
4,595,434 A 6/1986 Eckstein et al.
4,618,066 A * 10/1986 Vail ..... A47J 41/00 206/217
4,750,642 A 6/1988 Eckstein et al.
5,076,425 A 12/1991 Plone
5,141,136 A * 8/1992 Tignor ..... B65D 1/06 215/381
5,188,253 A * 2/1993 Poore ..... B29C 66/612 215/901
5,209,795 A 5/1993 DeRosa et al.
5,230,429 A 7/1993 Etheredge, III
5,820,016 A 10/1998 Stropkay
5,829,611 A 11/1998 Beck
5,988,460 A 11/1999 Brecheisen et al.
5,996,859 A 12/1999 Beck
8,439,221 B2 * 5/2013 Davis ..... A45F 3/18 220/592.01
10,894,642 B2 1/2021 Cerveny
11,172,784 B2 * 11/2021 Pinelli ..... C25D 7/04
2002/0074367 A1 * 6/2002 Kawakita ..... B65D 23/04 222/534
2003/0127469 A1 * 7/2003 Terry ..... B65D 1/06 222/158
2006/0102654 A1 * 5/2006 Seys ..... B65D 1/06 222/94
2006/0243756 A1 * 11/2006 Kawakita ..... B65D 51/1683 222/185.1
2007/0284332 A1 * 12/2007 Gowans ..... B65D 23/00 215/44
2010/0084362 A1 4/2010 Letchinger et al.
2010/0089776 A1 4/2010 Anthony et al.
2010/0242249 A1 9/2010 Vroon
2010/0288723 A1 * 11/2010 Mayer ..... B65D 47/247 215/316
2010/0288827 A1 11/2010 Booth
2013/0284764 A1 * 10/2013 Baxter-Waller ..... B65D 1/06 222/321.9
2016/0016699 A1 * 1/2016 West ..... B65D 43/0212 220/794
2016/0332788 A1 * 11/2016 Chen ..... B65D 1/0207
2018/0009589 A1 1/2018 Ho
2018/0050925 A1 * 2/2018 Gregory ..... B65D 1/06
2020/0256016 A1 8/2020 Chung et al.
2020/0407100 A1 12/2020 Hsu
2021/0047086 A1 2/2021 Prusko et al.
2022/0136174 A1 * 5/2022 Chung ..... D21H 17/55 220/669
2022/0234781 A1 * 7/2022 Suvarna ..... B65D 15/08
2022/0402666 A1 12/2022 Koenigseder et al.
2023/0020804 A1 1/2023 Kawasaki et al.
2024/0262590 A1 8/2024 Rittri
2025/0000288 A1 1/2025 Rittri

FOREIGN PATENT DOCUMENTS

CN 101500898 A 8/2009
CN 104129574 A 11/2014
CN 108455000 B 6/2020
CN 211869935 U 11/2020
DE 29906115 U1 8/1999
DE 20200901196 U1 6/2010
EP 1081285 A1 3/2001
FR 428966 A 9/1911
GB 1263107 A 2/1972
GB 1353360 A 5/1974
JP 2001/171640 A 6/2001
WO WO 03/099548 A1 12/2003
WO WO 2010/045080 A1 4/2010
WO WO 2020/016409 A1 1/2020

OTHER PUBLICATIONS

Swedish Office Action in Swedish Application No. 2150671-2, dated Jan. 19, 2022, in 8 pages.
International Search Report and Written Opinion issued in International Application No. PCT/EP2022/062835 mailed Sep. 12, 2022, in 11 pages.
International Search Report and Written Opinion received in International Application No. PCT/EP2022/063893, dated Sep. 23, 2022, in 10 pages.
International Search Report and Written Opinion received in International Application No. PCT/SE2022/051087, dated Dec. 19, 2022, in 13 pages.

* cited by examiner

CONTAINER WITH BOTTOM OPENING AND METHOD OF FILLING SUCH CONTAINER

TECHNICAL FIELD

The present disclosure relates generally to the technical field of containers and, more particularly, to containers with more than one opening, and even more particularly to containers with more than one opening made from a paper material.

BACKGROUND

Containers for fluids, beverages, and granular products, such as coffee grounds, spices, or other foodstuffs, come in different sizes, shapes and materials. Many of the standard containers are today at least partially made from plastics and or different paper materials.

Plastic materials are convenient to use to make containers. However, plastics are generally not biodegradable and compostable and therefore cause a lot of pollution.

Many containers are today not suitable for being refilled. Certain containers have one opening that is intended to be used as a spout for pouring or delivering the content of the container, however the same opening is often not suitable for refilling the container which makes the container more likely to be discarded after the first usage.

There is therefore a need in the field to provide new kinds of container for at least partially removing some of the problems mentioned.

SUMMARY

The inventor has reached the insight that there is a need for a container which can be effectively sealed after being filled with a granular substance or a fluid or beverage. The inventor has further reached the insight that there is a need in the field for a container which has more than one opening to be able to provide openings for different purposes. For example, the inventor has reached the insight that an opening intended to empty a bottle, for example a spout for drinking, is not automatically suitable for refilling the container. Further, the inventor has reached the insight that there is a need for a container with a shape that allows for an effective stacking and packing for the container while empty. The inventor has also reached the insight that there is a need for a container as described made from a sustainable and more environmentally friendly material than that of prior art solutions.

More and more sustainable solutions for reducing plastic pollution are becoming available to the market. Molding paper pulp, fiber-materials, is a standard way of making containers, trays, and other types of packaging. Generally, the steps are as follows: A mold is made to be a mirror image of the finished paper product; Holes are drilled through the mold and a screen attached to its surface; The mold is immersed into paper pulp; A vacuum is drawn through the holes when the mold is immersed in the paper pulp so that a layer of paper pulp sticks to the mold, the screen prevents pulp from clogging the holes.

The mold is removed, and the paper pulp stuck to the side of the mold is removed and dried, a paper product has been created. Depending on the type of paper product different techniques may be used for removing the product from the mold. In what is known as "wet" manufacturing a transfer mold mates with the fiber product and moves the formed "wet part" to a hot press which compresses and dries the fiber material to increase density and to provide a smooth external surface finish.

Other ways of molding paper pulp are available. For example, by pressing the material between a female and male mold water can be drained from the material and a paper product with a wanted shape may be created.

Paper materials, such as fiber-based products are recyclable, biodegradable, compostable and do not end up in the oceans in the same capacity as plastics. Therefore, they are preferable to be used as an alternative to many plastic products available today.

Paper materials are advantageous over plastic products in many aspects. However, beverage containers, bottles or containers made from paper materials may need some sort of inner lining or coating depending on the beverage or product to be served and the time the beverage or product is to be kept inside the container. This may for example be some sort of coating along the inner surface of the container that is water impermeable. The coating may be made from many different materials such as cellulose-based materials or plastics.

Other factors that may increase the environmental footprint of a product is how well it can be stacked or packed to ensure that transport of a bulk of the product is as environmentally friendly as possible. Having a shape that allows for effective stacking is therefore important. Prior art containers are often non stackable and comprises shapes that is unsuitable for stacking the containers both when unfilled and filled.

Today many containers have a single opening for dispensing the product held inside. These opening are often not configured to be used to refill the container, which is disadvantageous. Many containers are made of materials that can be used many times and it is a waste of resources in only using them once.

The present disclosure seeks to provide at least some embodiments of a container which overcome at least some of the above-mentioned drawbacks. More specifically, the present disclosure aims at providing a container comprising two openings.

In a first aspect of the present disclosure there is provided a container configured to hold a fluid or granular substance and extending along an axis A. The container comprises a top part. The top part comprises a container body configured to hold the fluid or granular substance, and a first opening with a first area. The container further comprises a bottom part configured to be permanently fitted to the top part. The bottom part comprises a second resealable opening with a second area, the second area is larger than the first area.

In a second aspect of the present disclosure there is provided a method for filling a container according to the invention with a fluid or granular substance. The method comprises filling a container body of a top part of the container with a fluid or granular substance. The method further comprises permanently attaching a bottom part to the container body, the bottom part comprises a second resealable opening.

Thus, there is provided a container with two separate openings. The present invention is advantageous in that one opening may be used for emptying the container, for example by drinking or pouring out a liquid or granular substance, and one opening for refilling the container. The second resealable opening may be used for refilling the container when empty, or for emptying the container depending on the usage of the container. There is also provided a method for filling the container.

The word "container" is not meant to narrow the scope of the invention. Container may mean an ordinary container, or a bottle, or any other suitable type of hollow structure that may hold a fluid or granular substance.

According to an embodiment the bottom part comprises a spout, and the second resealable opening is arranged in the spout. The spout may be configured to be large enough for a user to refill the container via the spout. The second opening may be located inside the spout and resealable by sealing and opening the spout. The spout may be any standard spout type available for containers or bottles.

According to another embodiment the spout comprises a set of threads extending around the spout. And the bottom part further comprises a cork comprising a set of corresponding threads and configured to be screwed onto said spout. The present embodiment is advantageous in that a screw-cork is an easy sealing method for a user to use and to ensure that the spout and second resealable opening is correctly closed.

According to another embodiment the spout comprises a spout sealing rim extending around the spout and protruding in a radial direction from the spout from said axis A. The bottom part further comprises a cork comprising a spout sealing recess wherein the cork is configured to be pressed onto the spout so that the spout sealing rim engages the spout sealing recess. The present embodiment is advantageous in that it provides a good and easy way for closing the second resealable opening by pressing the cork onto the spout.

According to another embodiment the spout extends into the container body when the bottom part is fitted to the top part, and the spout comprises a spout wall extending around the second opening and having a tapered shape. The present embodiment is advantageous in that the spout acts like a funnel for allowing easy refill of the container. The spout may have a tapered shape, meaning that the spout may have two holes with different sizes, with a first cross-sectional area and a second cross-sectional area wherein the first cross-sectional area may be larger than the second one. The spout may extend between these areas giving it a tapered shape. The larger hole may be placed at the bottom, so that when a user refills the bottle the user fills through the larger opening. The substance or fluid is then guided into the container via the spout and out of the smaller opening.

According to another embodiment the spout wall is tilted an angle beta in relation to the axis A, and the spout is sealed by a cork with a cork wall tilted the angle beta and being fitted into the spout so that the cork wall engages the spout wall. The present embodiment is advantageous in that the friction between the spout and the cork will be sufficient in closing and sealing the second resealable opening. Preferably the container is made from a material which creates sufficient friction for the cork to stick inside the spout.

According to another embodiment the angle beta is between 2-8 degrees. The present embodiment is advantageous in that in that if the angle beta is too big, the sealing structure will easily fall out from the bottom part. If the angle is between, 2-8 degrees the sealing structure can be pressed into the first opening of the bottom part and a tight seal will be achieved. More preferably, beta is between 4-6 degrees which will help achieve an even tighter seal.

According to another embodiment the container body comprises an annular wall tilted with an angle alpha in relation to the axis A. The bottom part comprises a sealing wall extending around the bottom part and tilted with the angle alpha in relation to the axis A and configured to engage the annular wall. The bottom part is configured to be permanently fitted into the top part by pressing it into the container body. The present embodiment is advantageous in that it provides a novel and easy way of closing the bottle. The friction between the annular wall and the sealing wall is enough to give the bottle a tight seal so that no glue, screwing or extra sealing mechanism is needed.

According to another embodiment the angle alpha is between 2-8 degrees. The present embodiment is advantageous in that in that if the angle alpha is too big, the sealing structure will easily fall out from the bottom part. If the angle is between, 2-8 degrees the sealing structure can be pressed into the first opening of the bottom part and a tight seal will be achieved. More preferably, alpha is between 4-6 degrees which will help achieve an even tighter seal.

According to another embodiment the bottom part further comprises a protruding rim extending around the sealing wall. The container body comprises a container sealing recess extending around the annular wall, and the protruding rim is arranged to engage the sealing recess. The present embodiment is advantageous in that the seal achieved may be even tighter than the seal without the protruding rim and sealing recess. The protruding rim is pressed into the sealing recess and achieves a seal. Further, it is advantageous in that a user may know when the bottle is closed sufficiently by feeling when the rim is received in the recess. It is understood that there may be more than one protruding rim and more than one sealing recess.

According to another embodiment the container body comprises a first set of container threads extending around the annular wall of the container body. The bottom part comprises a second set of container threads extending around the sealing wall. And the bottom part is configured to be screwed into the container body. The present embodiment is advantageous in that the bottom part and container body does not need to be tilted. It may give more options in design for someone that wants to produce and sell a beverage of granular substance in the container presented throughout the application. Other ways of fitting the bottom part to the top part are also plausible.

According to another embodiment, the container is made of a paper material. The present embodiment is advantageous in that the paper material is biodegradable and more environmentally friendly than plastic. It is further advantageous in that paper material can easily be made quite stiff or rigid which is preferable. With paper material it is meant any kind of paper material, cellulose-based material or fiber-based material that is recyclable and/or biodegradable. The paper material may be formed by different kinds of mixtures of fiber materials, recycled materials or other type of materials used in paper making.

According to another embodiment, the paper material is formed by fiber-based slurry comprising a fiber base comprising at least 50% by weight of old corrugated container (OCC), a moisture barrier, and an oil barrier. The moisture barrier and the oil barrier are in a range of about 1%-4% by weight respectively. The present embodiment is advantageous in that OCC is a recycled material which further decreases the environmental footprint of the product.

According to another embodiment, the paper material is formed by a fiber-based slurry comprising a fiber base comprising at least 10% softwood (SW), a moisture barrier, and an oil barrier. The moisture barrier and the oil barrier are in a range of about 1%-4% by weight respectively. The present embodiment is advantageous in that SW, for example bamboo or bagasse, is an environmentally preferable material to plastic. Further, a fiber-based slurry with the mentioned components creates a good mixture for a beverage container or bottle. The present embodiment is further advantageous in that some SW-materials are the residues from other industries and is therefore material which does not drain the resources of the planet more than necessary but instead may help give the product a decreased environmental footprint.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features.

BRIEF DESCRIPTION OF THE DRAWINGS

Exemplifying embodiments will now be described in more detail, with reference to the following appended drawings.

DETAILED DESCRIPTION

Figure 1:
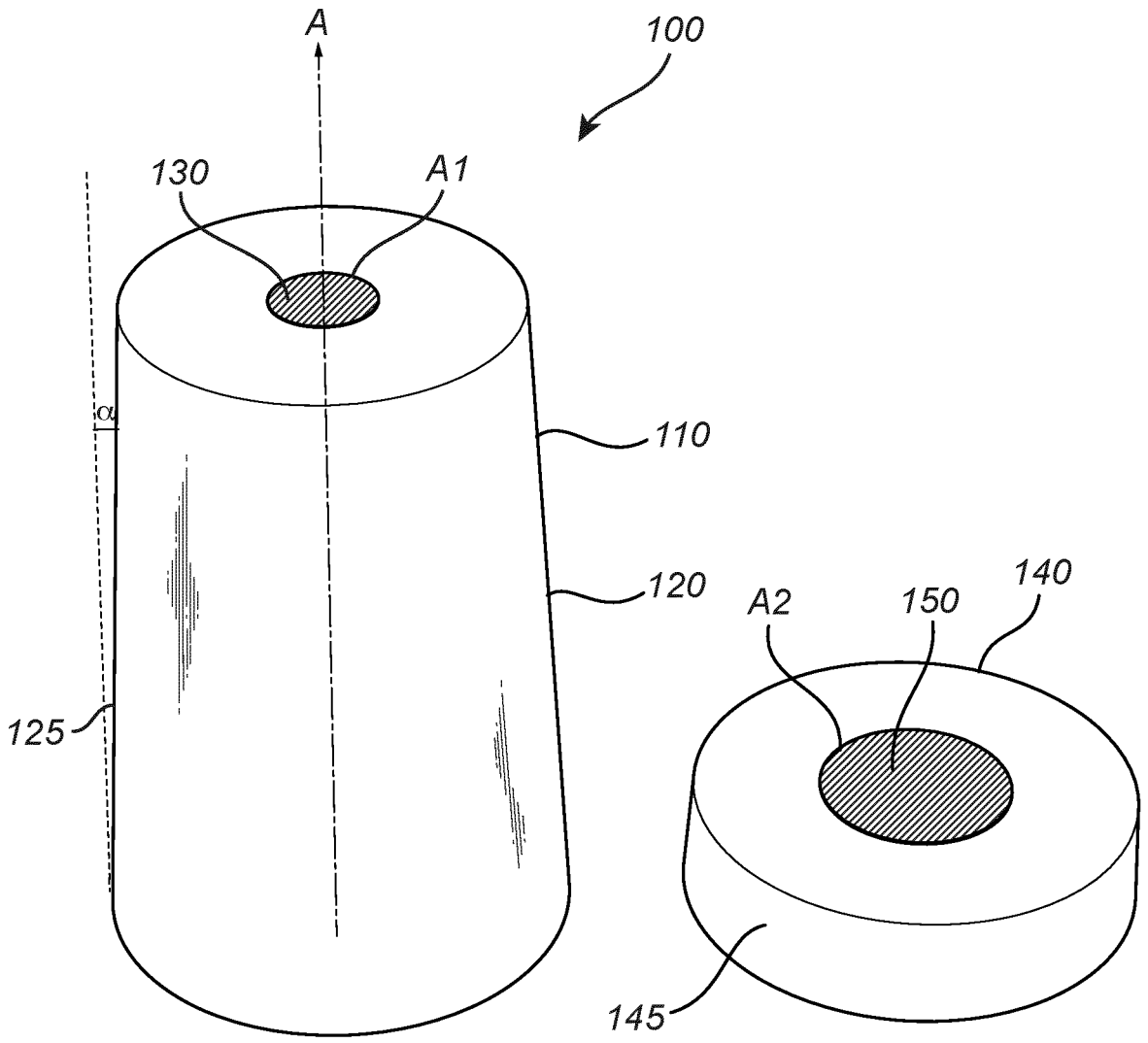
FIG. 1 schematically illustrates an exemplary container in accordance with an embodiment.

As illustrated in the figures, the sizes of the elements and regions may be exaggerated for illustrative purposes and, thus, are provided to illustrate the general structures of the embodiments. Like reference numerals refer to like elements throughout.

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

It is understood that the shape of the embodiments shown in the figures may be altered depending on the usage for the bottle. Different shapes are convenient in different situations, and the bottle or container may for example resemble the standard take-away cups or plastic bottles or they may not. The drawings are not intended to narrow the scope of protection for the shape of the bottle.

With reference to FIG. 1 there is disclosed an illustration of a container 100 according to an embodiment of the invention.

The container 100 is configured to hold a fluid or granular substance. The container 100 is extending along an axis A and comprises a top part 110 and a bottom part 140. The top part 110 comprises a container body 120 configured to hold the fluid or granular substance. The top part 110 further comprises a first opening 130 with a first area A1. The bottom part 140 is configured to be permanently fitted to the top part 110. The bottom part 140 comprises a second resealable opening 150 with a second area A2. The second area A2 is larger than the first area A1.

The container body 120 of the container 100 of FIG. 1 comprises an annular wall 125 tilted with an angle alpha α in relation to the axis A. The bottom part 140 further comprises a sealing wall 145 extending around the bottom part 140 and tilted with the angle alpha in relation to the axis A. The sealing wall 145 is configured to engage the annular wall 125. The bottom part 140 is configured to be permanently fitted into the top part 110 by pressing it into the container body 120.

The angle alpha α may be between 2-8 degrees. It may also be between 4-6 degrees. The angle alpha α may be picked depending on the material of the container 100 and depending on the friction that is created between the annular wall 125 and the sealing wall 145. A too large angle alpha α is not preferable since the bottom part 140 may fall out. An angle alpha α around 6 degrees is preferable. However, it may, as stated, be different angles for different embodiments and materials that are preferable.

The first opening 130 may be configured in many different ways. The first opening 130 may for example be located on a top side of the top part 110 but it may also be arranged on a side wall of the container 100, for example the annular wall 125. The first opening 130 may be arranged within a spout and which can be used for drinking, in case the content of the container is a beverage. The first opening 130 may be covered by a permeable surface that can be easily opened to reach a content of the container 100. The first opening 130 may be configured to be closed and opened only when a consumer wants to reach a content of the container 100. The first opening 130 may also be configured to be resealable, for example via a lid that is screwed, pressed or in any other convenient way mounted to the top part 110 to seal the first opening 130.

The container 100 may have a shape which allows it to be effectively stacked when empty and when filled. The shape of the top part 110 may allow multiple top parts 110 to be stacked together. A user may then take a top part 110 from a stack, fill the top part 110 with a fluid or granular substance and then seal it with a bottom part 140 taken from a stack of bottom parts 140.

The container 100 may be made of a paper material. In some embodiments only certain parts of the container may be made of a paper material.

With paper material is meant any material that is made of fiber-based, cellulose-based materials or similar materials that are biodegradable and recyclable.

The parts of the container 100 may for example be made of a fiber-based material. For example, a fiber-based slurry can be pressed or shaped to form some sort of paper material, cardboard material, or other biodegradable material.

The paper material may be formed by a fiber-based slurry. Fiber-based products are biodegradable, compostable and do not end up in the oceans in the same capacity as plastics. Therefore, they are preferable to be used as an alternative to many plastic products available today.

In different embodiment the parts of the container 100 may be formed by different types of fiber-based slurries. Here follow a few examples, however they are not seen as limiting and other materials and mixtures and proportions are also considered.

The paper material may be formed by a fiber-based slurry that may comprise at least 50% by weight of old corrugated container (OCC). Further, it may comprise a moisture barrier, and an oil barrier. The moisture barrier and the oil barrier may be in a range of about 1%-4% of weight respectively.

The paper material may be formed by a fiber-based slurry that may, in another embodiment, comprise at least 10% softwood (SW). Further, it may comprise a moisture barrier, and an oil barrier. The moisture barrier and the oil barrier may be in a range of about 1%-4% of weight respectively.

The fiber-base slurry may also have a base fiber from any of the following groups: bagasse, bamboo, newsprint (NP). Other types of fiber materials are also available for forming the paper material.

The fiber-based slurry may also comprise a strength additive in a range of 1.5%-4% by weight. This may be added to enhance structural rigidity.

Molding paper pulp, fiber-materials, is a standard way of making containers, trays, and other types of packaging. Generally, the steps are as follows: A mold is made to be a mirror image of the finished paper product; Holes are drilled through the mold and a screen attached to its surface; The mold is immersed into paper pulp; A vacuum is drawn through the holes when the mold is immersed in the paper pulp so that a layer of paper pulp sticks to the mold, the screen prevents pulp from clogging the holes.

The mold is removed, and the paper pulp stuck to the side of the mold is removed and dried, a paper product has been created. Depending on the type of paper product different techniques may be used for removing the product from the mold. In what is known as "wet" manufacturing a transfer mold mates with the fiber product and moves the formed "wet part" to a hot press which compresses and dries the fiber material to increase density and to provide a smooth external surface finish.

The parts of the container 100 may be formed according to the above stated procedure by the fiber-based slurry and a vacuum former. It may be formed for example by a method containing the steps of providing a fiber-based slurry mixture. Immersing a mold including a wire mesh comprising a mirror image of parts of the bottle to be formed. Then drawing a vacuum across the wire mesh to cause the fiber-based slurry to accumulate at a surface of the wire mesh. Then removing the mold from the fiber-base slurry mixture, removing molded parts from the surface of the wire mesh. Lastly pressing the molded parts in a hot press. However, other steps of standard vacuum forming may be incorporated into the method for achieving a functional bottle 100 and corresponding container parts.

The different parts of the container 100 may be formed in other ways as well. For example, a female and male mold of the container body 120 may be constructed. A fiber-based slurry, or other suitable material, may be poured into the female mold. The male mold may then be used to press the material to the sides of the female mold creating the correct shape. The molds may be constructed so that the water within the material is drained away through a mesh in the female and male mold while pressing.

Other ways of forming the container 100 and the different parts of the bottle are also possible, and the skilled man understands that different options are available. Depending on the part and depending on different features of the embodiments different ways of forming the paper material may be preferable.

It may further be advantageous for the container 100 to comprise a water impermeable coating. The coating may be made of a plastic material and may be a thin sheet covering an inside of the container 100. For example, an inner side of the top part 110 and a top side of the bottom part 140. The coating may be impermeable and allow for the beverage to be stored without penetrating the coating and reaching the walls of the container 100. The coating may be made from a plastic material or any other suitable material which is water impermeable, for example some cellulose-based materials.

Depending on the beverage or substance stored within the container 100 and the time the substance is stored the container 100 may comprise such a coating. For example, some beverages affect or damage paper-materials more than others, and therefore a coating may be needed for certain beverages. Further, depending on the storage time of the beverage within the bottle 100 a coating may be preferable. The longer a beverage is kept within the bottle 100 the higher the risk that the container 100 is affected be the beverage. Therefore, a coating may be preferable for containers 100 configured to store a beverage a longer period. The coating may have different thicknesses depending on the material it is made from and depending on the beverage to be stored.

Further, it is also possible that parts of the container 100 are made of other materials. For example, the container 100 may comprise a lid element for covering the first opening which may be made of plastic, silicon, or a metal. The lid element may then be used multiple times and on different containers 100 in case of the original container 100 being damaged. It may be advantageous in making some parts of the container 100 from material that is more durable and suitable for long time use and some parts of the container 100 of more environmentally friendly material such as fiber-based materials. For example, a silicon or metal lid element may be customizable and fit all containers 100. A user may then have a lid element with a certain color so that a user knows it is their container 100.

Figure 2:
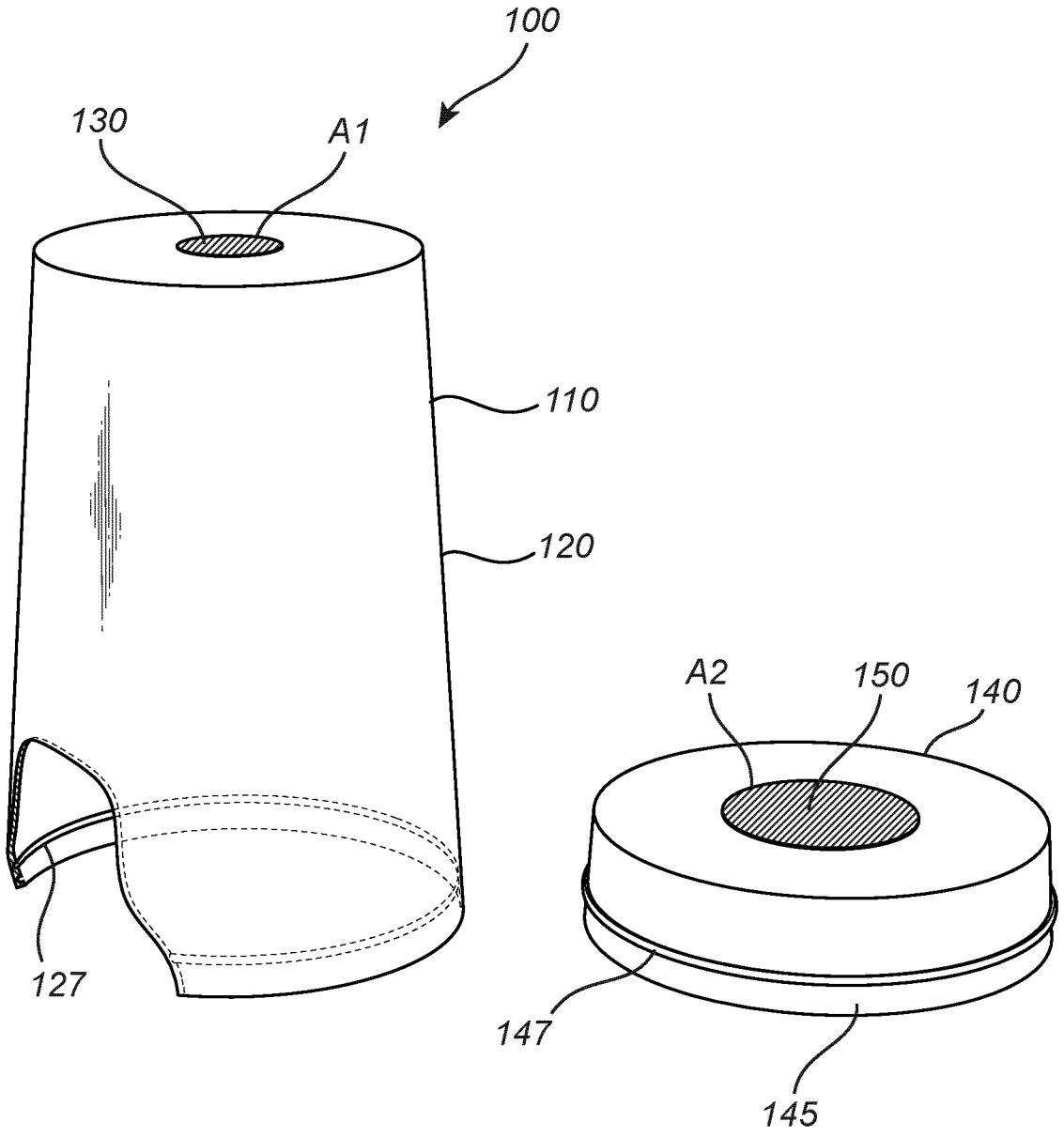
FIG. 2 schematically illustrates an exemplary container in accordance with an embodiment.

With reference to FIG. 2 there is disclosed an illustration of a container 100 according to an embodiment of the invention.

The container 100 disclosed in FIG. 2 may contain any features of the container 100 disclosed in FIG. 1.

The container 100 comprises a top part 110 and a bottom part 140 configured to be permanently fitted to the top part 110. The bottom part 140 comprises a sealing wall 145 extending around the bottom part 140. The bottom part 140 further comprises a protruding rim 147 extending around the sealing wall 145. The protruding rim 147 may be extending outwards from the sealing wall 145 and from the axis A when the bottom part 140 is fitted to the top part.

The container body 120 comprises a container sealing recess 127 extending around the annular wall 125. The container sealing recess 127 is configured to receive the protruding rim 147 when the bottom part 140 is attached to the top part 110. The bottom part 140 may be configured to be pressed into the top part 110 until the protruding rim 147 engages the sealing recess 127.

It is understood that more than one sealing recess 127 may be extending around the annular wall 125 and that the bottom part 140 may comprise more that one protruding rim 147 configured to be placed in the sealing recesses 127.

Figure 3:
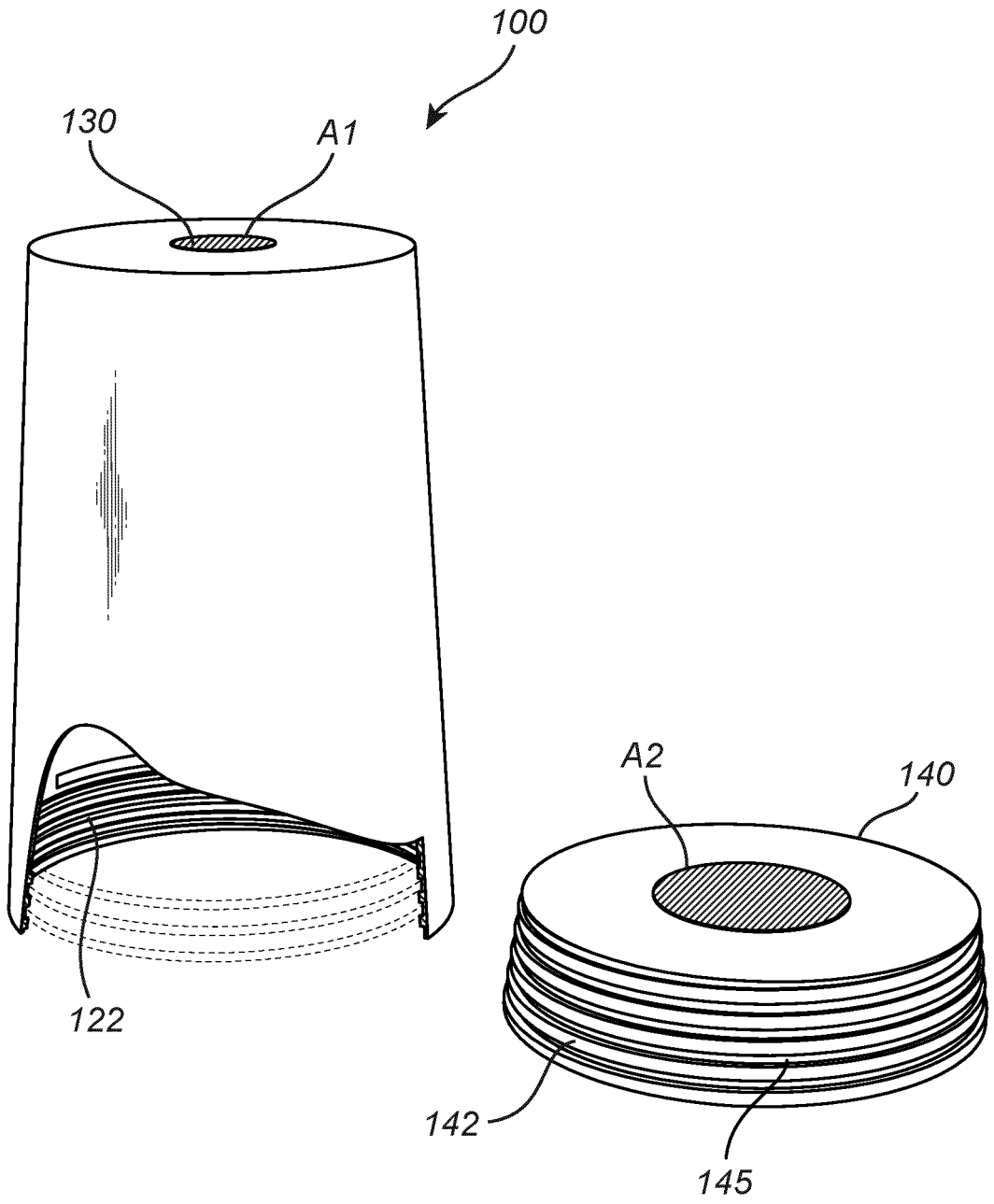
FIG. 3 schematically illustrates an exemplary container in accordance with an embodiment.

With reference to FIG. 3 there is disclosed an illustration of a container 100 according to an embodiment of the invention.

The container 100 disclosed in FIG. 3 may contain any features of the container 100 disclosed in FIG. 1.

The container body 120 disclosed in FIG. 3 comprises a first set of container threads 122 extending around the annular wall 125 of the container body 120. The bottom part 140 comprises a second set of container threads 142 extending around the sealing wall 145 of the bottom part 140. The bottom part 140 is configured to be screwed into the container body 120 in order to close and seal the container 100.

Figure 4:
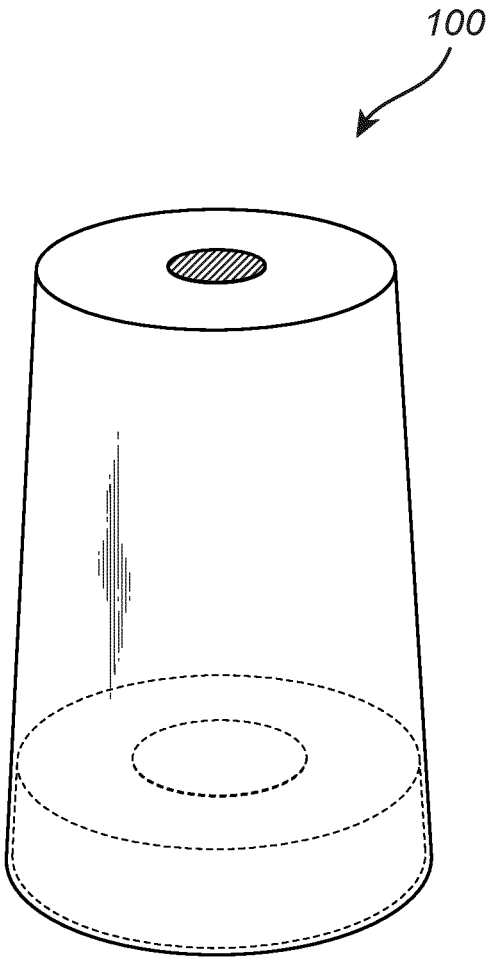
FIG. 4 schematically illustrates an exemplary container in accordance with an embodiment.

With reference to FIG. 4 there is disclosed an illustration of a container 100 according to an embodiment of the invention.

The container 100 in FIG. 4 is closed and ready for distribution. The bottom part 140 has been fitted to the top part 110 in order to create a closed and sealed container 100. The container 100 may correspond to any container described throughout the application.

With reference to FIGS. 5*a*, 5*b*, 5*c* and 5*d* exemplary bottom parts 140 for containers 100 in accordance with embodiments of the invention are disclosed.

The bottom parts 140 disclosed in Figured 5*a,b,c,d* are suitable for use with any of the container 100 disclosed in relation to the other Figures and may comprise any of the features presented in relation to those figures.

Figure 5A:
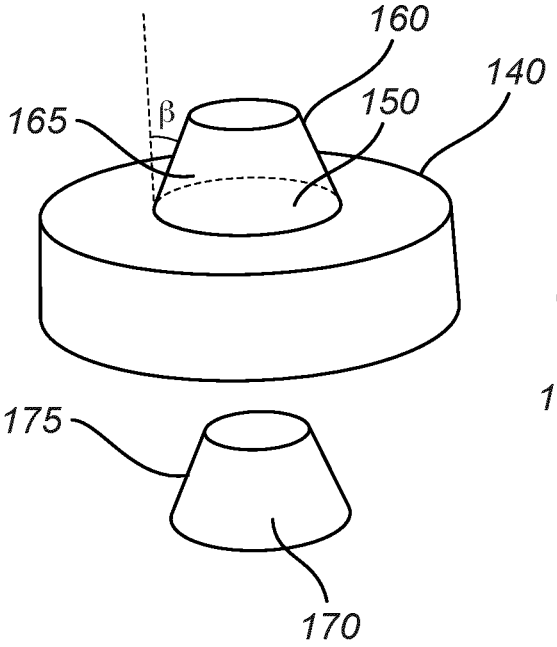
FIG. 5*a,b,c,d* schematically illustrate exemplary bottom parts for containers in accordance with embodiments of the invention.

The bottom parts 140 in FIG. 5*a,b,c,d* comprise a spout 160. The second resealable opening 150 is arranged in the spout 160. The spout 160 may have many different sizes and shapes. Some embodiments will now be described in further detail.

In FIG. 5*a* the spout 160 extends into the container body of a container when the bottom part 140 is fitted to the top part of the container. The spout comprises a spout wall 165 extending around the second resealable opening 150 and has a tapered shape. The spout wall 165 may be tilted with an angle beta β in relation to the axis A. The spout 160 may be closed by a cork 170 with a cork wall 175 tilted the angle beta β and being fitted into the spout 160 so that the cork wall 175 engages the spout wall 165. The friction between the cork 170 and the spout 160 will ensure a seal of the second resealable opening 150.

The angle beta β may be between 2-8 degrees. More preferably it may be between 4-6 degrees.

Figure 5B:
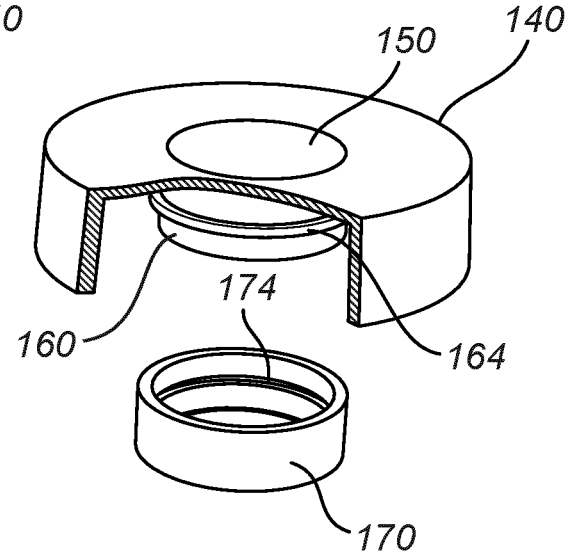

In FIG. 5*b* the spout 160 extends downwards and away from the top part when the bottom part 140 is fitted to the top part of the container. The spout 160 comprises a spout sealing rim 164 extending around the spout and protruding in a radial direction from the spout and from the axis A. The bottom part 10 further comprises a cork 170 comprising a spout sealing recess 174.

The cork 170 is configured to be pressed onto the spout 160 so that the spout sealing rim 174 engages the spout sealing recess 174 and is received within. This help achieving a tight and secure seal for the second resealable opening 150 placed within the spout 160.

Figure 5C:
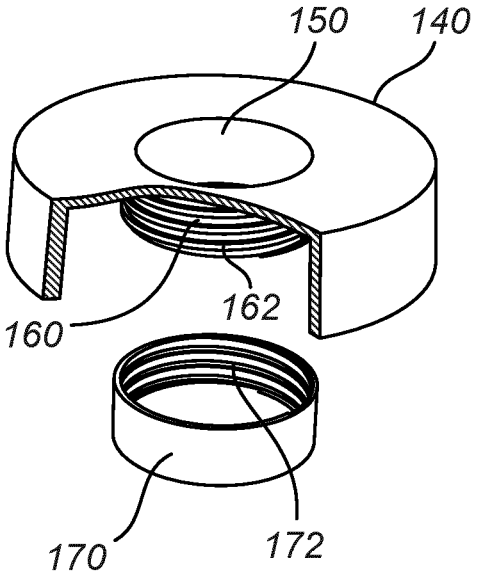

In FIG. 5*c* the spout 160 extends downwards and away from the top part when the bottom part 140 is fitted to the top part of the container. The spout 160 comprises a set of threads 162 extending around the spout 160. The bottom part further comprises a cork 170 comprising a set of corresponding threads 172. The cork 170 is configured to be screwed onto the spout 160. This help achieving a tight and secure seal for the second resealable opening 150 placed within the spout 160.

Figure 5D:
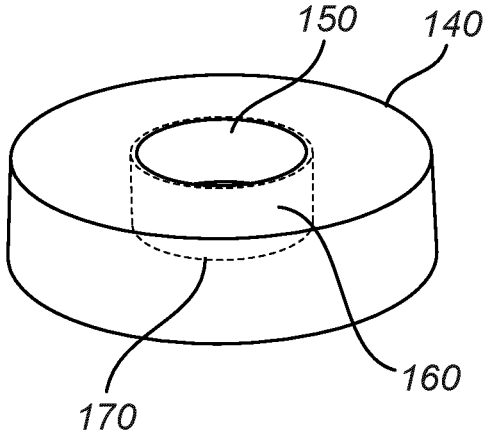

In FIG. 5*d* the cork 170 has been placed on the spout 160 and the second resealable opening 150 is sealed and closed.

Although features and elements are described above in particular combinations, each feature or element can be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. A container configured to hold a fluid or granular substance and extending along an axis, said container comprising a top part and a bottom part;

said top part comprising;

a container body configured to hold said fluid or granular substance; and a first resealable opening with a first area;

said bottom part configured to be permanently fitted to said top part, said top part and said bottom part being fitted to each other to form said container, wherein said bottom part comprises a second resealable opening with a second area, and wherein said second area is larger than said first area, wherein said container body comprises an annular wall having a top portion and a bottom portion, the annular wall tilted with constant angle alpha in relation to said axis from the top portion to the bottom portion, the angle alpha being between 2-8 degrees, wherein said bottom part comprises a sealing wall extending around said bottom part and tilted with said angle alpha in relation to said axis and configured to engage said annular wall, wherein said bottom part is configured to be permanently fitted into said top part by pressing it into said container body such that a tight seal between the annular wall of said container body and the sealing wall of said bottom part is obtained only using friction between said annular wall and said sealing wall, and wherein said container is made of a molded paper pulp material; and wherein said annular wall and said sealing wall are complementary tapered surfaces tilted with a constant angle alpha of between 2-8 degrees in relation to said axis, wherein said sealing wall is configured to engage the entirety of said annular wall adjacent to the bottom portion of the annular wall.

2. The container according to claim 1, wherein said bottom part comprises a spout, and wherein said second resealable opening is arranged in said spout.

3. The container according to claim 2, wherein said spout comprises a set of threads extending around said spout, and wherein said bottom part further comprises a cork comprising a set of corresponding threads and configured to be screwed onto said spout.

4. The container according to claim 2, wherein said spout comprises a spout sealing rim extending around said spout and protruding in a radial direction from said spout from said axis, and wherein said bottom part further comprises a cork comprising a spout sealing recess, wherein said cork is configured to be pressed onto said spout so that said spout sealing rim engages said spout sealing recess.

5. The container according to claim 2, wherein said spout extends into said container body, and wherein said spout comprises a spout wall extending around said second resealable opening and having a tapered shape.

6. The container according to claim 5, wherein said spout wall is tilted an angle beta in relation to said axis, and wherein said spout is sealed by a cork with a cork wall tilted said angle beta and being fitted into said spout so that said cork wall engages said spout wall.

7. The container according to claim 6, wherein said angle beta is between 2-8 degrees.

8. The container according to claim 1, wherein said bottom part further comprises a protruding rim extending around said sealing wall, and wherein said container body comprises a container sealing recess extending around said annular wall, and wherein said protruding rim is arranged to engage said sealing recess.

9. The container according to claim 1, wherein said paper material is formed from a fiber-based slurry comprising;

a fiber base comprising at least 50% by weight of old corrugated container (OCC);

a moisture barrier; and an oil barrier, wherein said moisture barrier and said oil barrier are in a range of about 1%-4% by weight respectively.

10. The container according to claim 1, wherein said paper material is formed from a fiber-based slurry comprising;

a fiber base comprising at least 10% softwood (SW);

a moisture barrier; and an oil barrier, wherein said moisture barrier and said oil barrier are in a range of about 1%-4% by weight respectively.

11. A method for filling a container according to claim 1 with a fluid or granular substance comprising:

filling a container body of a top part of said container with a fluid or granular substance; and permanently attaching a bottom part to said container body, wherein said bottom part comprises a second resealable opening.

* * * * *